US007677064B2

(12) United States Patent
Kim et al.

(10) Patent No.: US 7,677,064 B2
(45) Date of Patent: Mar. 16, 2010

(54) DOOR OF DRUM TYPE WASHING MACHINE

(75) Inventors: Gon Kim, Jinhae-si (KR); Jae Kyum Kim, Kimhae-si (KR); Chi Wan Hur, Changwon-si (KR); Yu Beom Kang, Changwon-si (KR); Sang Man Je, Keoje-si (KR)

(73) Assignee: LG Electronics Inc., Seoul (KR)

( * ) Notice: Subject to any disclaimer, the term of this patent is extended or adjusted under 35 U.S.C. 154(b) by 901 days.

(21) Appl. No.: 11/053,948

(22) Filed: Feb. 10, 2005

(65) Prior Publication Data

US 2006/0006661 A1 Jan. 12, 2006

(30) Foreign Application Priority Data

Feb. 13, 2004 (KR) ..... 10-2004-0009708

(51) Int. Cl.
*D06F 37/28* (2006.01)

(52) U.S. Cl. ..... 68/196

(58) Field of Classification Search ..... 68/3 R, 68/12.02, 12.26, 196
See application file for complete search history.

(56) References Cited

U.S. PATENT DOCUMENTS

| | | | | |
|---|---|---|---|---|
| 2,745,133 | A * | 5/1956 | McWethy | 16/225 |
| 6,568,719 | B2 * | 5/2003 | Buscella | 292/85 |
| 6,582,276 | B1 * | 6/2003 | Bao | 446/479 |
| 2004/0089031 | A1 * | 5/2004 | Kim et al. | 68/196 |
| 2004/0244435 | A1 * | 12/2004 | Kim | 68/12.26 |

FOREIGN PATENT DOCUMENTS

| | | | |
|---|---|---|---|
| DE | 2 320 507 | A | 6/1998 |
| EP | 0 610 824 | A | 8/1994 |
| EP | 0 728 861 | A | 8/1996 |
| GB | 2 080 399 | * | 2/1982 |
| GB | 2 081 858 | * | 2/1982 |
| JP | 04-231997 | * | 8/1992 |
| WO | WO 03/004754 | * | 5/2002 |
| WO | WO 03/004754 | A | 1/2003 |

OTHER PUBLICATIONS

WIPO WO 93/23601 Nov. 1993.*

* cited by examiner

*Primary Examiner*—Frankie L Stinson
(74) *Attorney, Agent, or Firm*—Birch, Stewart, Kolasch & Birch, LLP

(57) ABSTRACT

Disclosed herein is a door of a drum type washing machine. The door comprises a ring-shaped door frame hingedly connected to the front surface of the cabinet at one lateral side thereof, a door glass disposed at an open center of the door frame, a grip casing mounted inside a grip hole formed at the other lateral side of the door frame for preventing the interior of the door frame from being exposed to the outside through the grip hole, and a hook assembly disposed at the grip casing for locking the door frame to the front surface of the cabinet at the other lateral side of the door frame. The interiors of the front door frame and the rear door frame are prevented from being exposed to the outside through the grip hole by the grip casing, and the hook assembly is easily and conveniently mounted to the door frame.

9 Claims, 10 Drawing Sheets

DOOR OF DRUM TYPE WASHING MACHINE

BACKGROUND OF THE INVENTION

1. Field of the Invention

The present invention relates to a door of a drum type washing machine having a hook assembly for locking the door, and, more particularly, to a door of a drum type washing machine that allows a hook assembly to be easily and conveniently mounted to the door and that is capable of preventing the pleasing appearance of the door from being spoiled due to a handle of the hook assembly.

2. Description of the Related Art

Generally, a drum type washing machine is a machine that washes the laundry using friction generated between a drum rotated by a driving force of a motor and the laundry while detergent, wash water, and the laundry are put in the drum, which is horizontally disposed.

FIG. 1 is a perspective view illustrating a conventional drum type washing machine.

As shown in FIG. 1, the conventional drum type washing machine comprises: a cabinet 2 forming the appearance of the drum type washing machine; a tub (not shown) horizontally disposed in the cabinet 2; a drum 4 rotatably disposed in the tub for washing the laundry; a plurality of lifting blades 6 attached to the inner circumferential surface of the drum 4 for lifting the laundry to a predetermined height such that the laundry drops from the lifting blades by gravity at the predetermined height; a motor 8 disposed at the rear of the tub for generating a driving force necessary to drive the drum 4; a cabinet cover 10 attached to the front part of the cabinet 2, the cabinet cover 20 being provided at the center thereof with a laundry inlet/outlet hole 10A for allowing the laundry to be put into or removed from the drum 4 therethrough; and a door 20 attached to the cabinet cover 10 for opening and closing the laundry inlet/outlet hole 10A.

Specifically, one lateral side of the door 20 is hingedly connected to the cabinet cover 10 by means of a door hinge 24, and at the other lateral side of the door 20 is disposed a hook assembly 28 for locking the door 20 to the cabinet cover 10 to prevent the door 20 from being accidentally opened.

When the other lateral side of the door 20 comes into contact with the cabinet cover 10, the hook assembly 28 is inserted in a locking fashion into a hook hole 10B formed at the cabinet cover 10.

The hook assembly 28 may be a handle type hook assembly or a non-handle type hook assembly. The handle type hook assembly has a handle, which is manipulated by a user of the drum type washing machine. In the handle type hook assembly, the door 20 is locked or unlocked through the user's manual manipulation of the handle. The non-handle type hook assembly has an additional locking mechanism (not shown), which is disposed at the hook hole side of the cabinet cover 10. In the non-handle type hook assembly, the door 20 is automatically locked or unlocked by the locking mechanism based on operations of the drum type washing machine.

Since the door 20 is automatically locked or unlocked by the locking mechanism based on operations of the drum type washing machine in the case of the non-handle type hook assembly, it is difficult to manufacture the hook assembly, it is costly to manufacture the hook assembly, and it is necessary to manufacture the hook assembly with high precision.

Since the door 10 is manually locked or unlocked through the user's manual manipulation of the handle in the case of the handle type hook assembly, on the other hand, it is easy to manufacture the hook assembly as compared to the non-handle type hook assembly, and the hook assembly can be economically manufactured. However, the handle type hook assembly has problems in that the appearance of the door 20 is not pleasing due to the presence of the handle and in that it is very difficult to mount the hook assembly to the door 20.

FIG. 2 is a perspective view illustrating one example of a conventional door 20 having a handle type hook assembly, and FIG. 3 is an exploded plan view illustrating a door frame of the door 20 shown in FIG. 2.

As shown in FIGS. 2 and 3, the conventional door 20 comprises: a ring-shaped door frame 22 hingedly connected to the front surface of the cabinet cover 10 at one lateral side thereof; a door hinge 24 (See FIG. 1), having both ends attached to one lateral side of the door frame 22 and the front cover of the cabinet cover 10, respectively, for hingedly supporting the door frame 22; a door glass 26 disposed at the center, which is opened, of the door frame 22; and a hook assembly 28 disposed at the other lateral side of the door frame 22 such that the hook assembly 28 is inserted in a locking fashion into a hook hole 10B formed at the front surface of the cabinet cover 10.

The door frame 22 is made of an injection-molded plastic material. The door frame 22 comprises: a front door frame part 30; and a rear door frame part 32 disposed at the rear surface of the front door frame part 30.

At one lateral side of the inner circumferential surface of the front door frame part 30 is formed a grip part 34, which is protruded inward such that the grip part 34 is gripped by a user of the drum type washing machine when the door 20 is opened or closed. At the inner circumferential surface of the front door frame part 30, which is opposite to the rear of the grip part 34, is formed an opening hole 31.

The edge of the door glass 26 is fixedly disposed between the front door frame part 30 and the rear door frame part 32 for hermetically sealing the opened center of the door frame 22.

The hook assembly 28 comprises: a hook 40 extending through the rear door frame part 32; a hook shaft 42, to which the hook 40 is hingedly attached, the hook shaft 42 having both ends respectively supported by supporting parts 36 formed at the front surface of the rear door frame part 32; a handle 44 having one lateral side hingedly attached to the hook shaft 42 and the other lateral side disposed at the rear of the grip part 34; and resilient members 46 disposed on the hook shaft 42 for resiliently supporting the hook 40.

At the rear door frame part 32 is formed a through-hole 38, through which the hook 40 is inserted. At the cabinet cover 10 is formed a hook hole 10B, which corresponds to the hook 40. The hook 40 is inserted in a locking fashion into the hook hole 10B such that the hook 40 is locked.

The handle 44 is inserted through the opening hole 31 of the front door frame part 30. When the handle is manipulated by the user of the drum type washing machine, the hook 40 is moved in a hinged fashion in the lateral direction of the drum type washing machine.

The resilient members 46 are coil springs disposed on the hook shaft 42. The inner ends of the resilient members 46 are held at both sides of the hook 40, respectively, and the outer ends of the resilient members 46 are held at the rear surface of the front door frame part 30.

In the door having the handle type hook assembly with the above-stated construction, the hook assembly 28 is mounted to the rear door frame part 32, and then the front door frame part 30 is securely fixed to the front surface of the rear door frame part 32 by means of a fixing member.

At this time, the edge of the door glass 26 is disposed between the inner circumferential parts of the front door frame part 30 and the rear door frame part 32, and therefore, the door glass 26 is securely fixed by the front door frame part 30 and the rear door frame part 32. The outer ends of the resilient members 46 of the hook assembly 28 are pressed by the front door frame part 30, and therefore, resilient forces are provided to the hook 40.

Subsequently, the door frame 22 is hingedly connected to the cabinet cover 10 by the door hinge 24 at one lateral side thereof.

When the handle 44 of the hook assembly 28 of the door 20 with the above-stated construction is pushed forward by the user of the drum type washing machine, the hook 40 is moved in a hinged fashion by the handle 44, and therefore, the hook 40 is disengaged from the hook hole 10B. When the user holds the grip part 34 of the front door frame part 30 in the above state, and then moves the door in a hinged fashion in the lateral direction of the drum type washing machine, the laundry inlet/outlet hole 10A is opened or closed by the door 20.

In the conventional door having the handle type hook assembly with the above-stated construction, however, the grip part 34 is protruded inward from the inner circumferential surface of the front door frame part 30 such that the handle 44 of the hook assembly 28 is hidden and the grip part 34 is held by the user of the drum type washing machine. As a result, the door frame 22 is not formed in the shape of a complete ring due to the grip part 34, and therefore, the pleasing appearance of the door 20 is spoiled.

Furthermore, the front door frame part 30 is securely fixed to the front surface of the rear door frame part 32 by means of the fixing member while the door hinge 24, the hook assembly 28, and the door glass 26 are disposed at the rear door frame part 32. As a result, the assembling process of the door frame 22 is very difficult, and the hook assembly 28 may be incorrectly assembled.

When the door frame 22 is assembled, for example, the hook shaft 42 may be accidentally separated from the door frame 22, or the outer ends of the resilient members 46 may not be correctly held at the rear surface of the front door frame part 30. For this reason, it is necessary to securely fix the front door frame part 30 to the front surface of the rear door frame part 32 while the hook assembly 28 is properly held. Consequently, the assembling process of the door frame 22 is very difficult.

FIG. 4 is a perspective view illustrating another example of a conventional door 21 having a handle type hook assembly, and FIG. 5 is an exploded plan view illustrating a door frame of the door 21 shown in FIG. 4.

Components of the conventional door 21 shown in FIGS. 4 and 5, which are identical or similar to those of the conventional door 20 shown in FIGS. 2 and 3, are indicated by the same reference numerals as those of the conventional door 20 shown in FIGS. 2 and 3, and a detailed description thereof will not be given.

As shown in FIGS. 4 and 5, a grip hole 35 is formed at the inner circumferential surface of the front door frame part 30 such that the user of the drum type washing machine can hold the grip hole 35 to open or close the door 21. The hook assembly 29, including the handle 45, is disposed inside the grip hole 35. Other construction of the conventional door 21 shown in FIGS. 4 and 5 is identical to that of the conventional door 20 shown in FIGS. 2 and 3.

One end of the handle 45 is hingedly attached to the hook shaft 42, and the other end of the handle 45 is disposed in the grip hole 35 such that the hook 40 is moved in a hinged fashion in the lateral direction of the drum type washing machine through the user's manipulation.

As described above, the handle 45 is not protruded out of the grip hole 35, and the front door frame part 30 is formed in the shape of a complete ring. Consequently, the pleasing appearance of the door 21 is not spoiled as shown in FIGS. 4 and 5, which is distinguished from the conventional door 20 shown in FIGS. 2 and 3, in which the pleasing appearance of the door 20 is spoiled due to the handle 44 and the grip part 34.

In the conventional door 21 shown in FIGS. 4 and 5, however, the hook assembly 29, including the handle 45, is disposed in the door frame 22, at which the grip hole 35 is formed. As a result, it is difficult to provide space sufficient to dispose the hook assembly 29 at the door frame 22, and therefore, the disposition of the hook assembly 29 is very difficult.

Furthermore, the interiors of the front door frame part 30 and the rear door frame part 32 are exposed to the outside through the grip hole 35, which affects the pleasing appearance of the door 21, and therefore, marketability of the drum type washing machines having such doors is lowered.

For example, the door frame 30 is made of an injection-molded plastic material, which does not provide high quality and luxurious appearance to the consuming public. The rear door frame part 32, which is not exposed to the outside, is not plated, although the surface of the front door frame part 30 is plated with a metal material to improve the pleasing appearance and surface hardness of the front door frame part 30. Consequently, the unplated front surface of the rear door frame part 32 and the complicated components in the door frame 22 are exposed to the outside through the grip hole 35, and therefore, the pleasing appearance of the door 21 is spoiled.

SUMMARY OF THE INVENTION

Therefore, the present invention has been made in view of the above problems, and it is an object of the present invention to provide a door of a drum type washing machine that allows a hook assembly to be easily and conveniently mounted inside a door frame and that allows the hook assembly to be disposed inside a grip hole of the door frame, thereby preventing the pleasing appearance of the door from being spoiled.

It is another object of the present invention to provide a door of a drum type washing machine that prevents the interior of the door frame from being exposed to the outside through the grip hole formed at the inner circumferential surface of the door frame, thereby improving the pleasing appearance of the door.

In accordance with one aspect of the present invention, the above and other objects can be accomplished by the provision of A door of a drum type washing machine, the door being hingedly attached to the front surface of a cabinet at one lateral side thereof for opening and closing a laundry inlet/outlet hole formed at the front surface of the cabinet, wherein the door comprises: a grip hole formed at the other lateral side of the door; a hook assembly mounted inside the grip hole for locking the door to the front surface of the cabinet; and a grip casing mounted inside the grip hole for preventing the inside of the door from being exposed to the outside through the grip hole.

In accordance with another aspect of the present invention, there is provided a door of a drum type washing machine comprising: a ring-shaped door frame hingedly connected to the front surface of the cabinet at one lateral side thereof; a door glass disposed at an open center of the door frame; a grip casing mounted inside a grip hole formed at the other lateral side of the door frame for preventing the interior of the door frame from being exposed to the outside through the grip hole; and a hook assembly disposed at the grip casing for locking the door frame to the front surface of the cabinet at the other lateral side of the door frame.

Preferably, the door frame comprises: a rear door frame forming the rear part of the door; and a front door frame attached to the front surface of the rear door frame, the front door frame forming the front part of the door, the door glass having an edge fitted between the front door frame and the rear door frame, the grip hole being formed at the inner circumferential surface of the front door frame.

Preferably, the grip casing is a box-shaped member attached to the rear surface of the front door frame and having an opening formed at the inner part thereof such that the opening communicates with the grip hole of the front door frame.

Preferably, the front door frame and the rear door frame are made of a plastic material, the front door frame having a plating layer formed at the surface thereof, and the grip casing has a plating layer formed at the surface thereof, the plating layer of the grip casing being made of the same plating material as the plating layer of the front door frame.

Preferably, the grip casing has a front surface attached to the rear surface of the front door frame, the front surface being opened, and a rear surface disposed in tight contact with the front surface of the rear door frame.

Preferably, the grip casing is provided at the outside part of the rear surface thereof with a locating rib, which surrounds the edge of the door glass for locating the door glass, and the grip casing is provided at the outside part of the rear surface thereof with a fixing rib, which is formed at the position where the door glass is in contact with the grip casing for pressing the edge of the door glass.

Preferably, the grip casing is provided at both sides thereof with a plurality of locking protrusions, and the front door frame is provided at the rear surface thereof with a plurality of locking parts having locking holes, into which the locking protrusions are inserted in a locking fashion, respectively.

Preferably, the grip casing is provided at both sides thereof with guide ribs for guiding the insertion of the locking protrusions into the locking parts, respectively.

Preferably, the front door frame and the rear door frame are provided with pluralities of fixing holes, respectively, and the grip casing is provided with at least one fixing hole, which communicates with the fixing holes of the front door frame and the rear door frame.

Preferably, the front door frame is provided at the rear surface thereof with a fixing boss, which communicates with the fixing hole of the front door frame, and the grip casing is provided with a boss insertion part, which communicates with the fixing hole of the grip casing such that the fixing boss of the front door frame is inserted into the boss insertion part.

Preferably, the grip casing is provided at the rear surface thereof with an insertion hole, through which the hook assembly is disposed, and the rear door frame is provided with a through-hole, which communicates with the insertion hole.

Preferably, the hook assembly comprises: a hook disposed through the insertion hole of the grip casing and the through-hole of the rear door frame, the hook having one end inserted in a locking fashion into a hook hole formed at the front surface of the cabinet; a hook shaft, to which the other end of the hook is hingedly attached, the hook shaft being supported at the rear surface of the grip casing; a handle rotatably attached to the hook shaft, the handle having one end held by the hook and the other end disposed in the opening; and resilient members disposed on the hook shaft for resiliently supporting the hook.

Preferably, the grip casing is provided at the inside part of the rear surface thereof with supporting parts for supporting both ends of the hook shaft, respectively.

Preferably, the supporting parts comprise: a first supporting part for supporting one end of the hook shaft; and a second supporting part for supporting the other end of the hook shaft, the insertion hole being formed between the first supporting part and the second supporting part.

According to the present invention, the interiors of the front door frame and the rear door frame are prevented from being exposed to the outside through the grip hole by the grip casing and the hook assembly is easily and conveniently mounted to the door frame.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
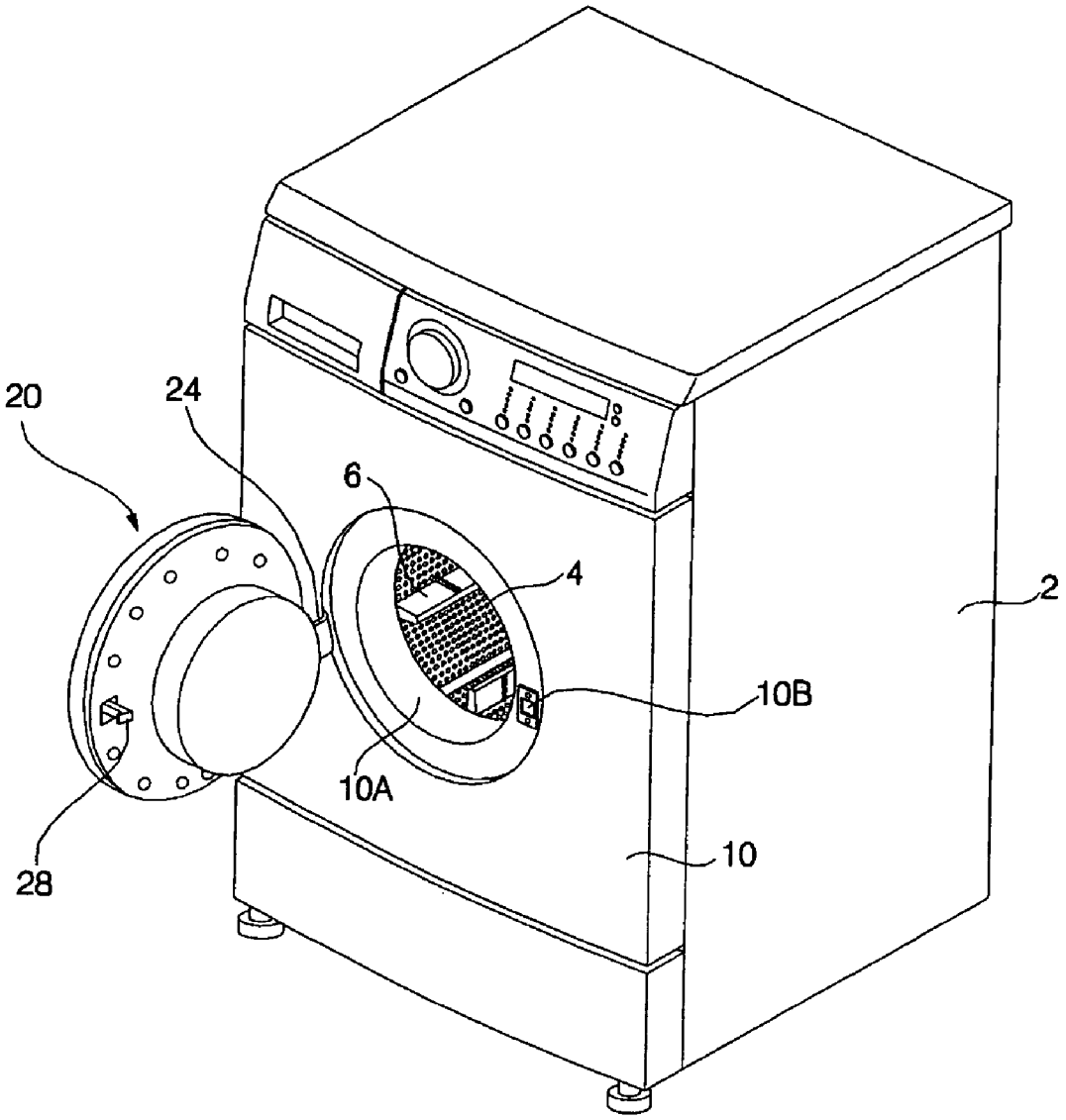
FIG. 1 (Prior art)
FIG. 1 is a perspective view illustrating a conventional drum type washing machine.
Figure 2:
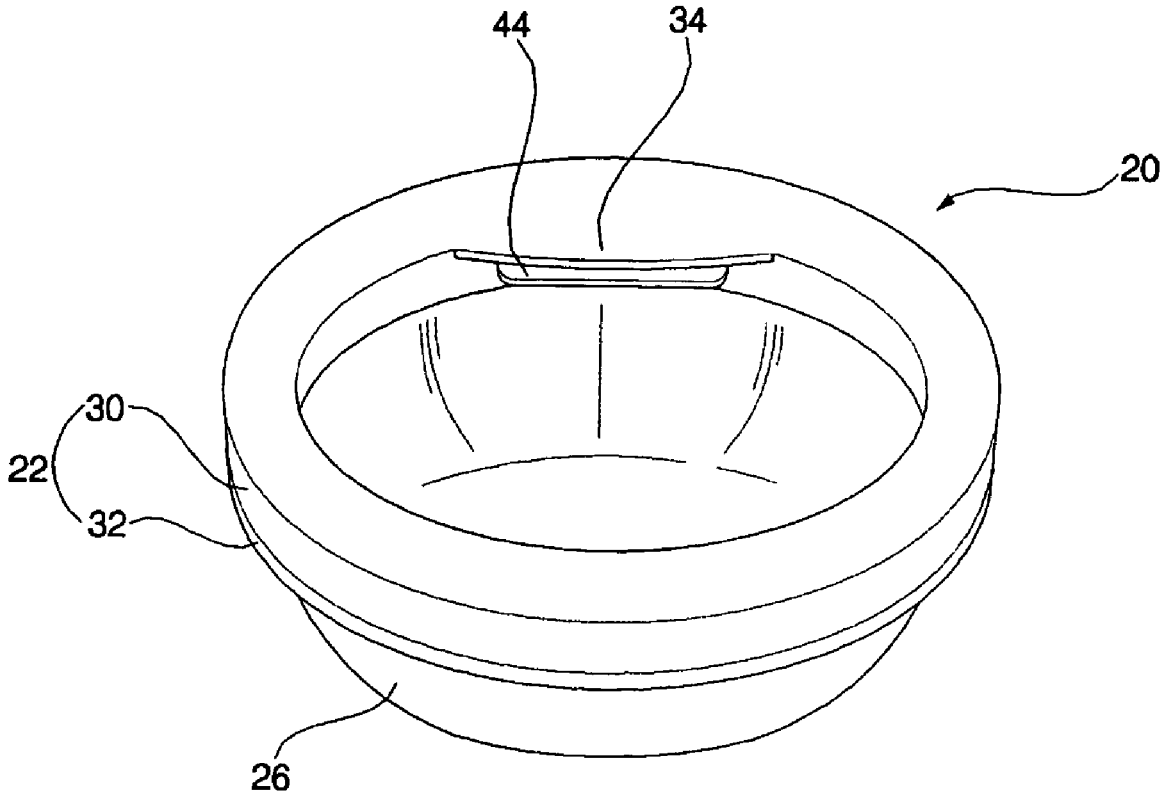
FIG. 2 (Prior art)
FIG. 2 is a perspective view illustrating one example of a conventional door having a handle type hook assembly.
Figure 3:
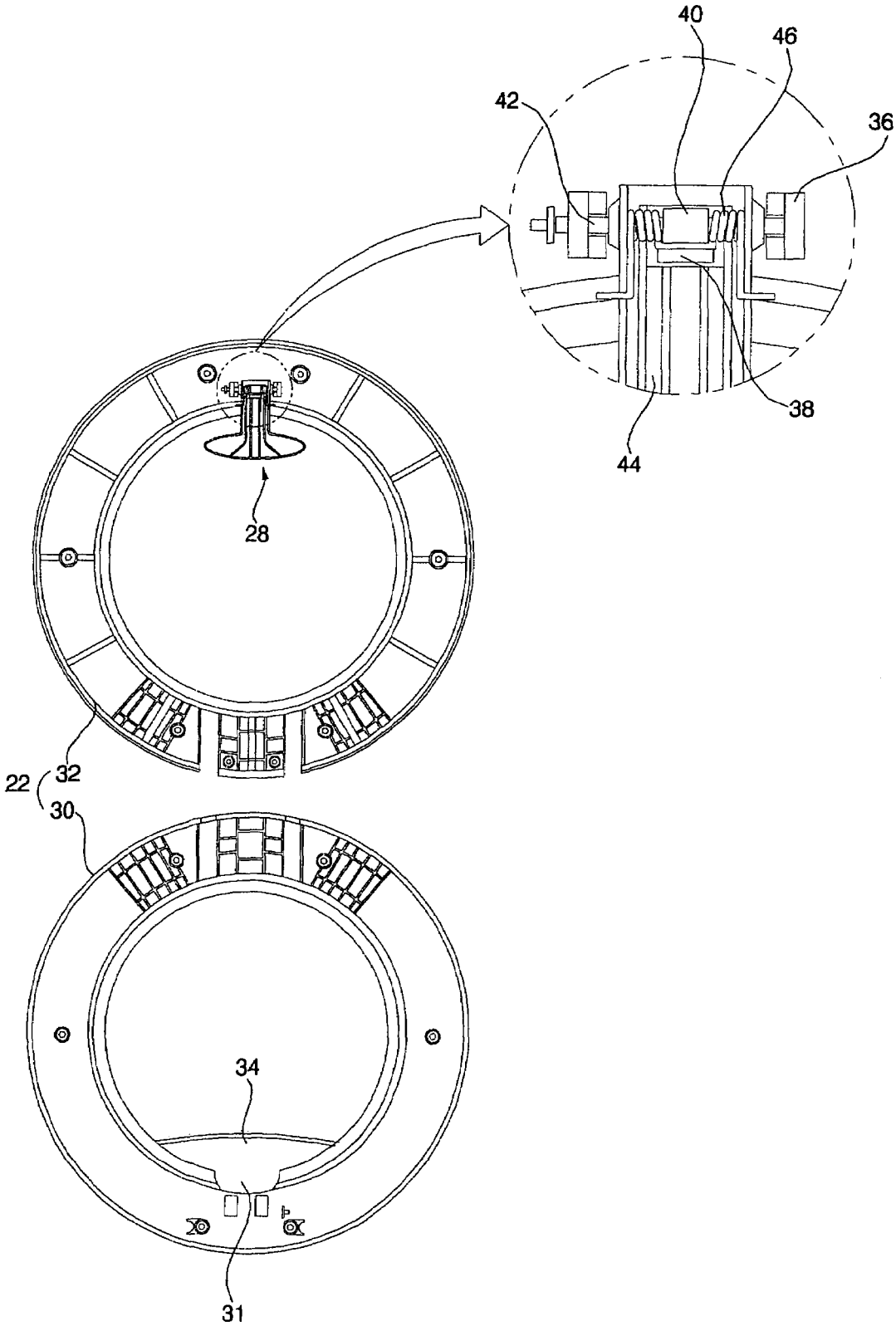
FIG. 3 (Prior art)
FIG. 3 is an exploded plan view illustrating a door frame of the door shown in FIG. 2.
Figure 4:
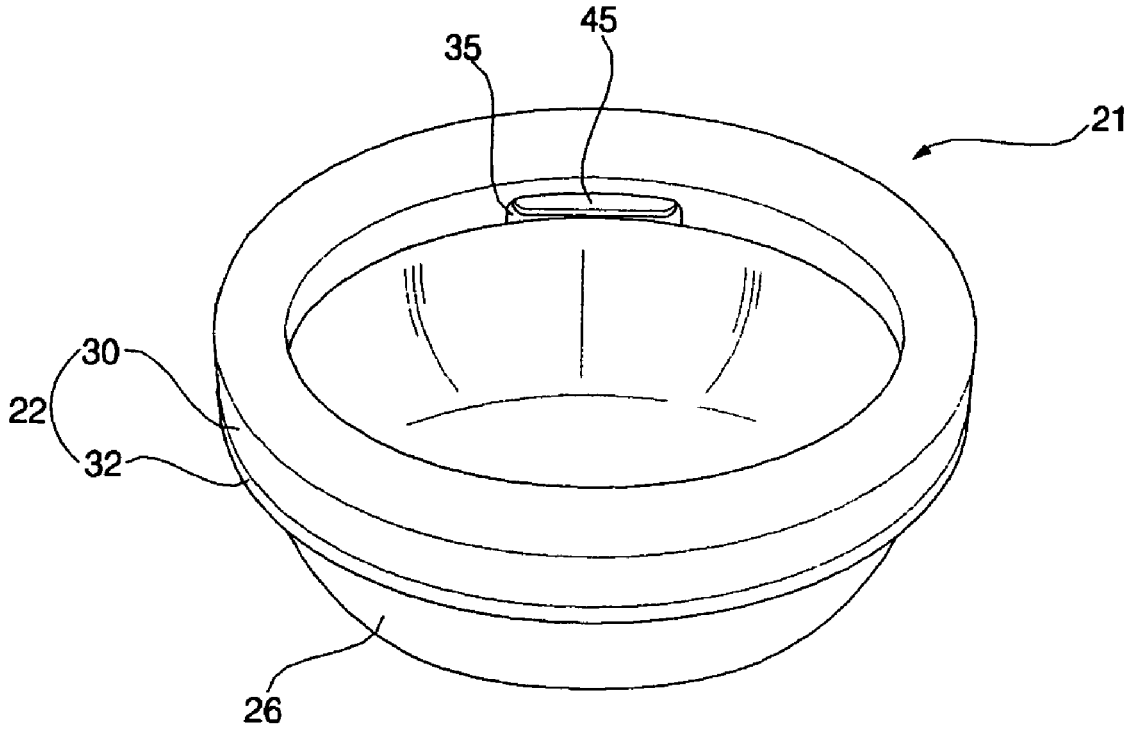
FIG. 4 (Prior art)
FIG. 4 is a perspective view illustrating another example of a conventional door having a handle type hook assembly.
Figure 5:
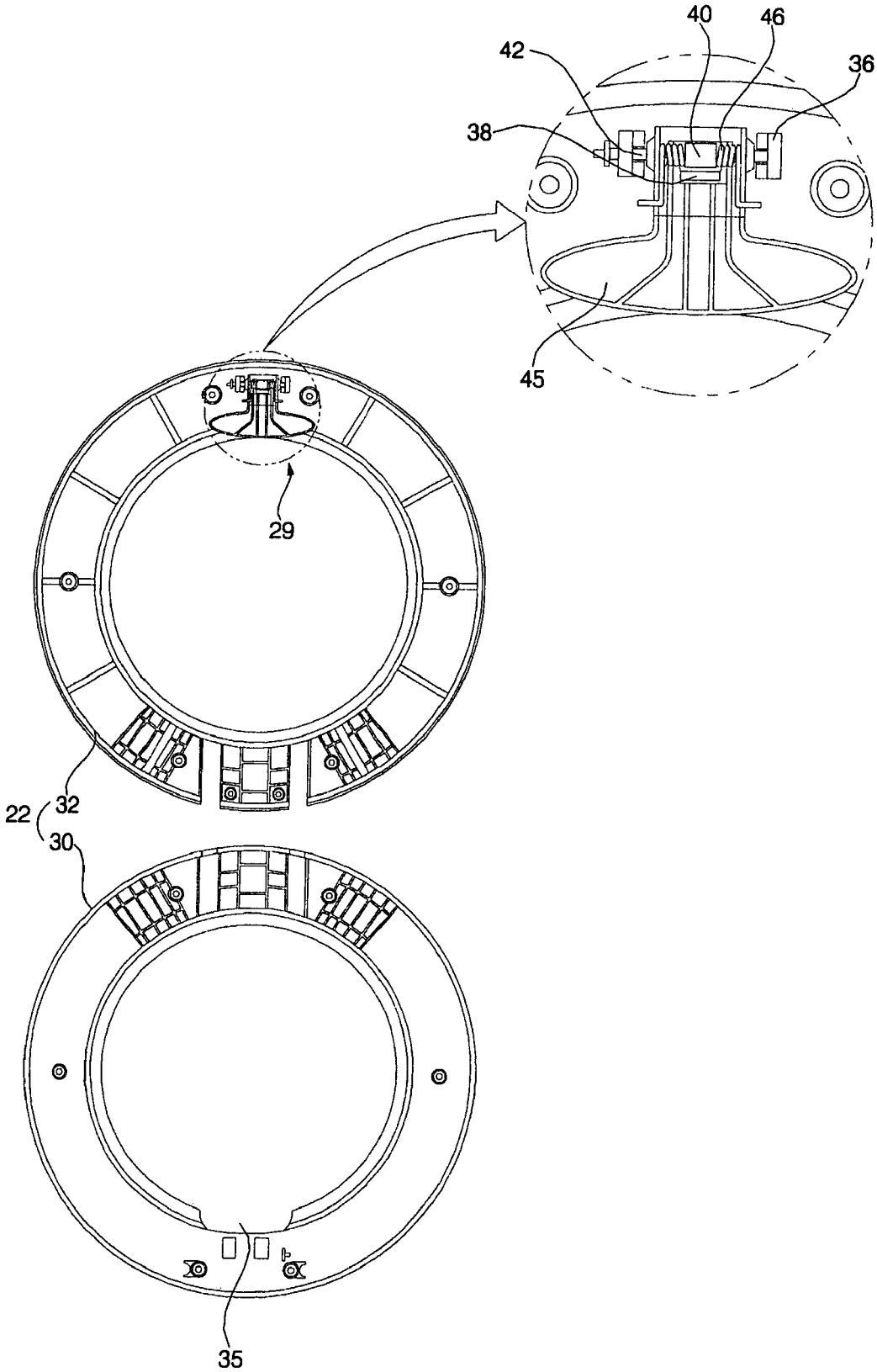
FIG. 5 is an exploded plan view illustrating a door frame of the door shown in FIG. 4.
Figure 6:
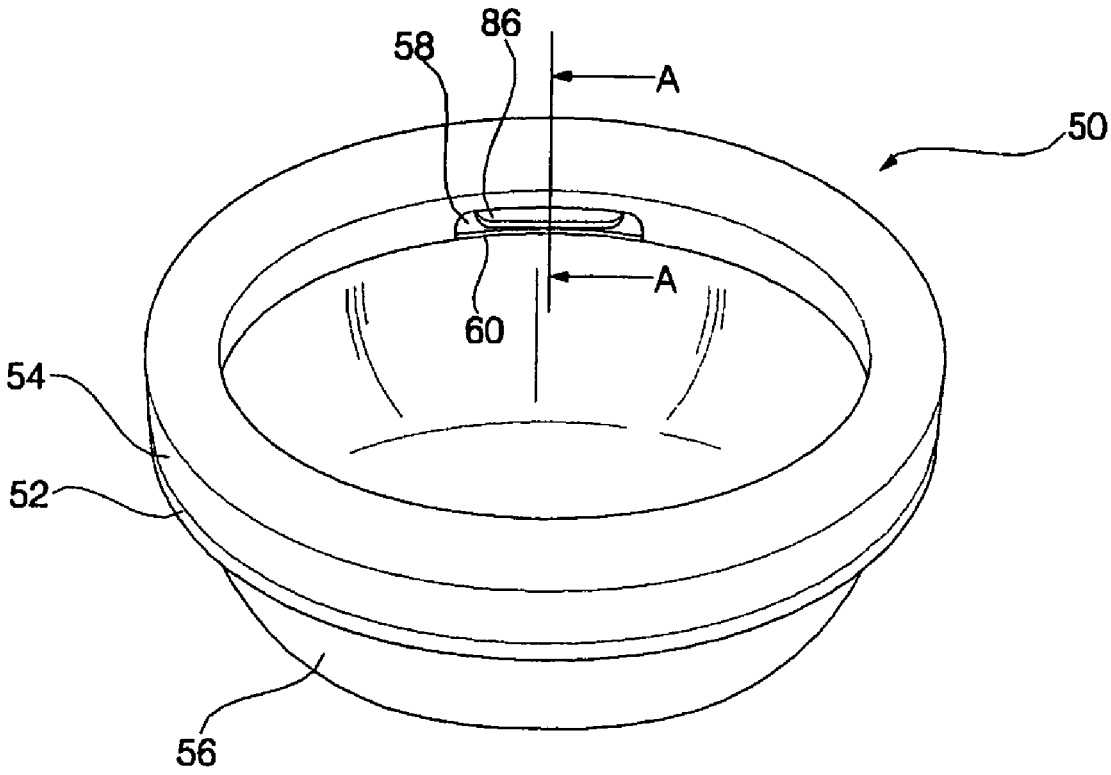
FIG. 6 is a perspective view illustrating a door of a drum type washing machine according to a first preferred embodiment of the present invention.
Figure 7:
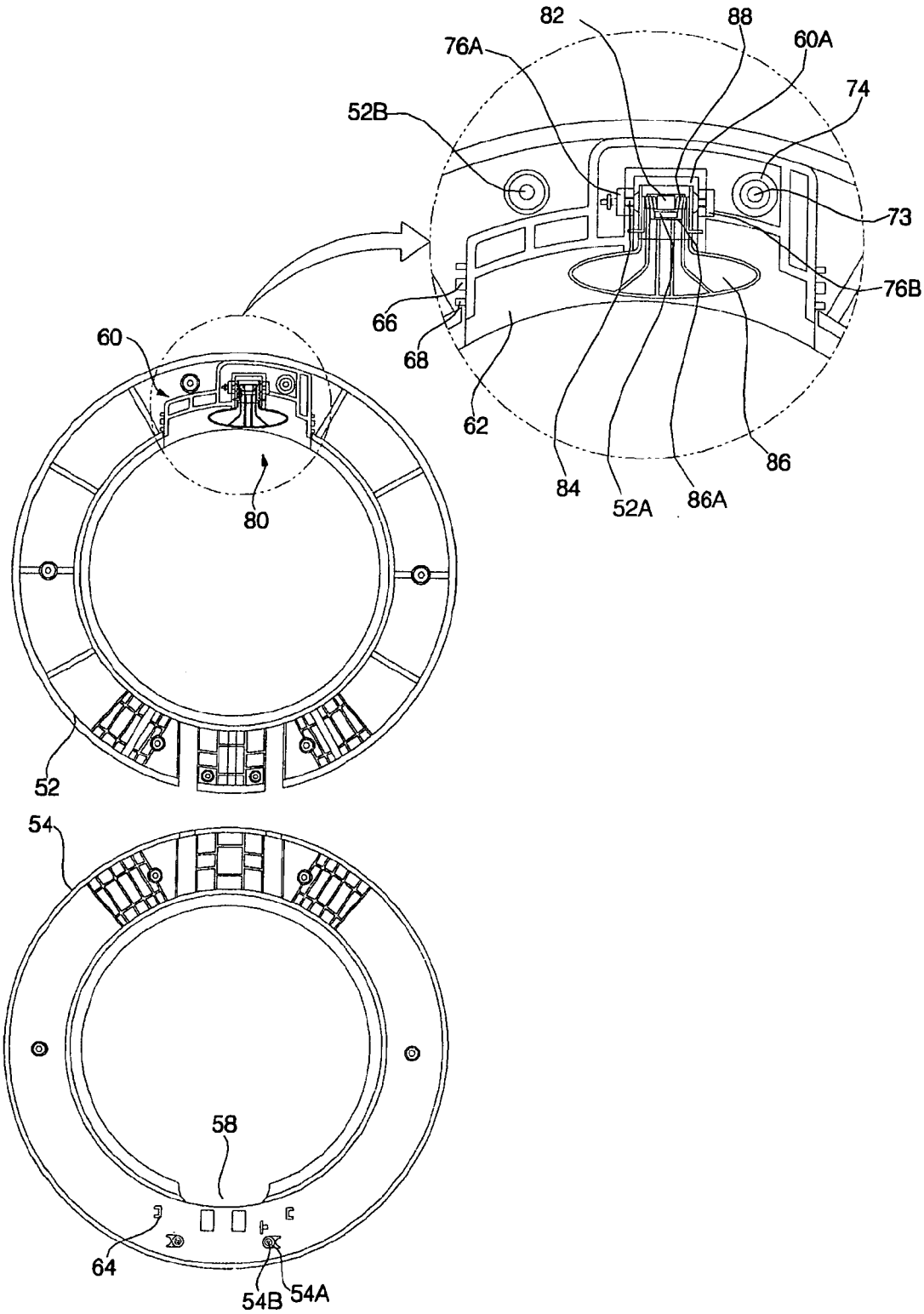
FIG. 7 is an exploded plan view illustrating a door frame of the door shown in FIG. 6.
Figure 8:
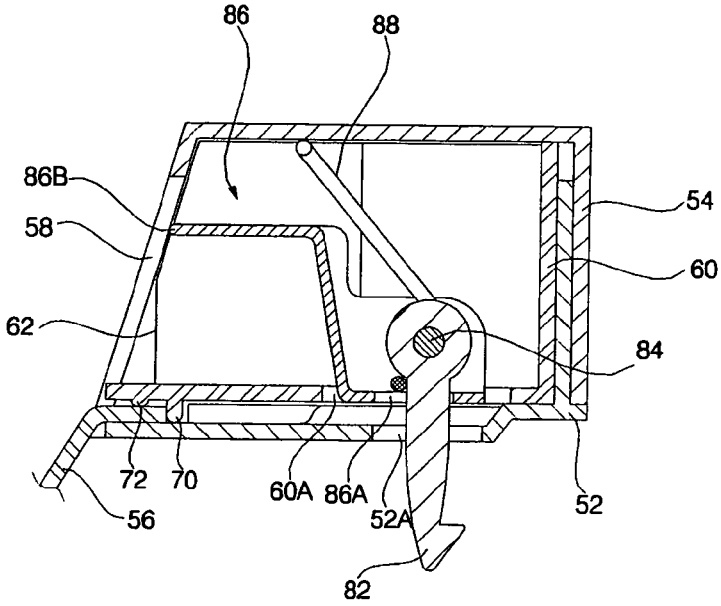
FIG. 8 is a sectional view taken along the line A-A of FIG. 6.
Figure 9:
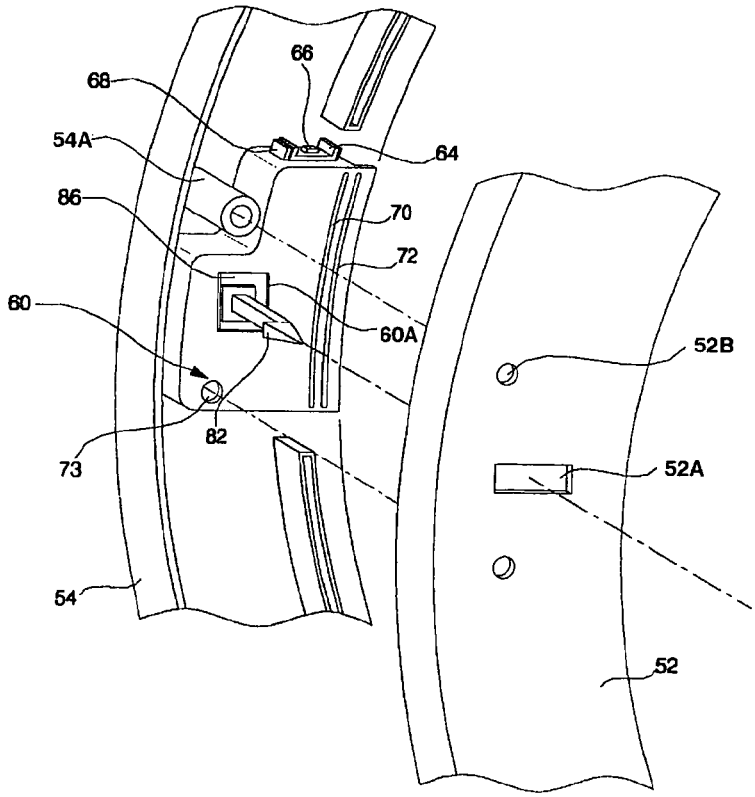
FIG. 9 is a perspective view, partially cutaway, illustrating principal components of the door shown in FIG. 8.
Figure 10:
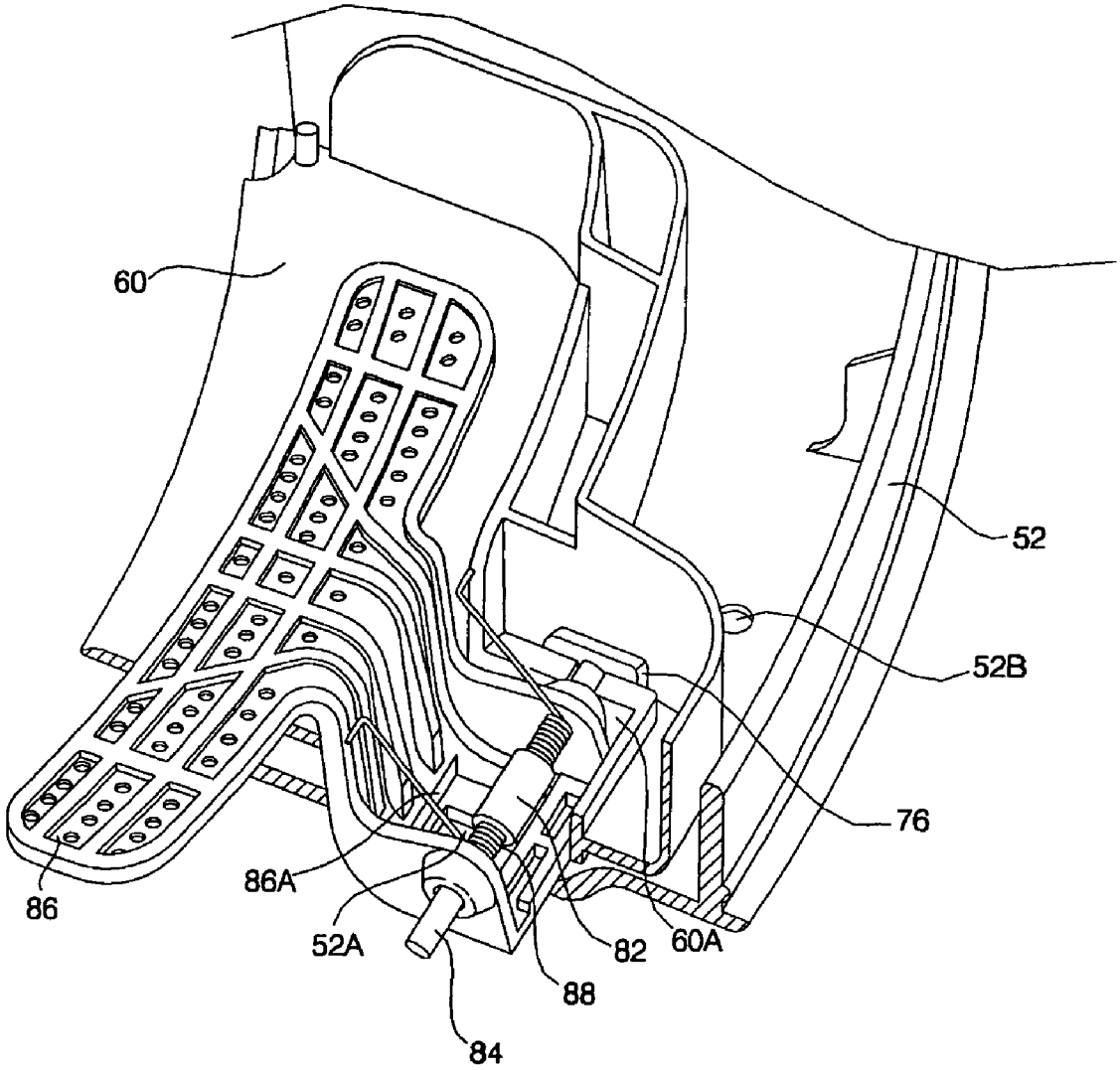
FIG. 10 is a perspective view, partially cutaway, illustrating assembly of the principal components of the door shown in FIG. 8.
Figure 11:
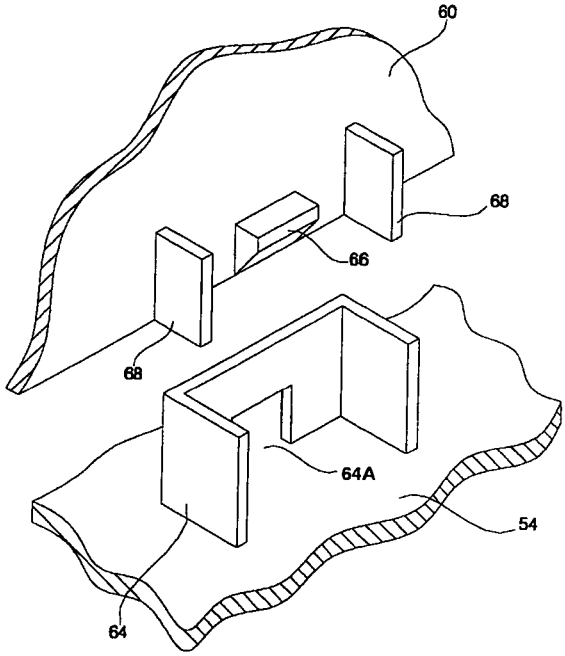
FIG. 11 is an exploded perspective view illustrating a locking protrusion and a locking part of the door shown in FIG. 10.

FIG. 6 is a perspective view illustrating a door 50 of a drum type washing machine according to a first preferred embodiment of the present invention, FIG. 7 is an exploded plan view illustrating a door frame of the door 50 shown in FIG. 6, FIG. 8 is a sectional view taken along the line A-A of FIG. 6, FIG. 9 is a perspective view, partially cutaway, illustrating principal components of the door 50 shown in FIG. 8, FIG. 10 is a perspective view, partially cutaway, illustrating assembly of the principal components of the door 50 shown in FIG. 8, FIG. 11 is an exploded perspective view illustrating a locking protrusion and a locking part of the door 50 shown in FIG. 10.

As shown in FIGS. 6 to 11, the door 50 comprises: a ring-shaped rear door frame 52 forming the rear surface of the door 50; a ring-shaped front door frame 54 attached to the front surface of the rear door frame 52, the front door frame 54 being provided at the inner circumferential surface thereof with a grip hole 58; a door glass 56 disposed at open centers of the front door frame 54 and the rear door frame 52, respectively, the door glass 56 having the edge securely fixed by the front door frame 54 and the rear door frame 52; a grip casing 60 mounted inside the grip hole 58 for preventing the interiors of the front door frame 54 and the rear door frame 52 from being exposed to the outside through the grip hole 58; and a hook assembly 80 disposed through the grip casing 60 for locking the front door frame 54 and the rear door frame 52 to the cabinet cover 10.

The front door frame 54 and the rear door frame 52 are made of an injection-molded plastic material. The front door frame 54, which forms the front surface of the door 50, is plated with a metal material to improve the pleasing appearance of the front door frame 54.

For example, chrome is typically used as a plating material for the front door frame 54. When a plating layer made of chrome is formed on the surface of the front door frame 54, the surface hardness of the front door frame 54 is improved while the front door frame 54 provides metal material feel and brilliance.

One lateral side of the front door frame 54 and one lateral side of the rear door frame 52 are hingedly connected to the cabinet cover by a door hinge. The hook assembly 80 is disposed at the other lateral side of the front door frame 54 and the other lateral side of the rear door frame 52 for selectively locking the door 50 to the cabinet cover.

Especially at the inner circumferential surface of the other lateral side of the front door frame 54 is formed a grip hole 58 for allowing a user of the drum type washing machine to hold when opening or closing the door 50.

The edge of the door glass 56 is disposed between the front door frame 54 and the rear door frame 52. When the front door frame 54 is securely fixed to the rear door frame 52 by means of a fixing member (not shown), the door glass 56 is disposed at the open centers of the front door frame 54 and the rear door frame 52 while being hermetically sealed.

To this end, the front door frame 54 and the rear door frame 52 are provided with pluralities of fixing holes 54B and 52B in the circumferential direction thereof while the fixing holes 54B formed at the front door frame 54 correspond to the fixing holes 52B formed at the rear door frame 52, respectively. While the drum type washing machine is operated, the interior of the drum can be seen through the door glass 56 from the outside.

The grip casing 60 is formed in the shape of a box having an open front part. At the inner part of the grip casing 60 is formed an opening 62. The grip casing 60 is attached to the rear surface of the front door frame 54 such that the opening 62 of the grip casing 60 communicates with the grip hole 58 of the front door frame 54. The opening 62 of the grip casing 60 has a size equal to or greater than that of the grip hole 58 of the front door frame 54.

The grip casing 60 is made of an injection-molded plastic material, and the surface of the grip casing 60 is plated with the same material as the plating material for the front door frame 54. The grip casing 60 forms the interior of the grip hole 58 together with the front door frame 54.

The grip casing 60 is provided at both sides thereof with a plurality of locking protrusions 66, which are inserted in a locking fashion into a plurality of locking parts 64 formed at the rear surface of the front door frame 54, respectively.

The locking parts 64 are protruded in the shape of a plate from the rear surface of the front door frame 54, to which the grip casing 60 is attached. At the centers of the locking parts 64 are formed locking holes 64A, into which the locking protrusions 66 are inserted in a locking fashion, respectively.

The locking parts 64 come into tight contact with the sides of the grip casing 60 when the grip casing 60 is attached to the front door frame 54. Consequently, the locking parts 64 serve to maintain positions where the grip casing 60 is attached are maintained and to guide the movement of the grip casing 60 when the grip casing 60 is attached to the front door frame 54.

At both sides of the grip casing 60 are also formed guide ribs 68 for guiding the insertion of the locking protrusions 66 into the locking parts 64 such that the locking protrusions 66 are exactly inserted in a locking fashion into the locking parts 64, respectively.

The guide ribs 68 are formed at the left and right sides of each of the locking protrusions 66 while the guide ribs 68 are in tight contact with both side ends of each of the locking parts 64, respectively.

The rear surface of the grip casing 60 is in tight contact with the front surface of the rear door frame 52, at which the edge of the door glass 56 is located. The grip casing 60 is provided at the center of the rear surface thereof with an insertion hole 60A, through which the hook assembly 80 is disposed. At the outside part of the rear surface of the grip casing is formed a locating rib 70 for locating the door glass 56.

At the rear door frame 52 is formed a through-hole 52A, which communicates with the insertion hole 60A such that the hook assembly 80 is inserted through the through-hole 52A.

The locating rib 70 is protruded from the outside part of the rear surface of the grip casing 60 such that the locating rib 70 surrounds the edge of the door glass 56 for locating the door glass 56.

At the outside part of the rear surface of the grip casing 60 is also formed a fixing rib 72, which is spaced apart from the locating rib 70 for securely fixing the edge of the door glass 56.

The fixing rib 72 is protruded while being spaced apart a predetermined distance from the door glass 56 toward the locating rib 70. Consequently, the fixing rib 72 securely fixes the edge of the door glass 56 by the coupling force between the front door frame 54 and the rear door frame 52.

Preferably, the front door frame 54 and the rear door frame 52 are provided at the positions corresponding to the positions where the locating rib 70 and the fixing rib 72 are formed with structural members corresponding to the locating rib 70 and the fixing rib 72, respectively.

At the rear surface of the grip casing 60 is formed at least one fixing hole 73, which communicates with the fixing holes 54B and 52B of the front door frame 54 and the rear door frame 52.

As a result, the fixing member engaged into the fixing holes 54B and 52B of the front door frame 54 and the rear door frame 52 are also engaged into the fixing hole 73, and therefore, the grip casing 60 is more securely mounted inside the front door frame 54 and the rear door frame 52.

At the rear surface of the front door frame 54 is formed a fixing boss 54A, which communicates with the fixing hole 54B of the front door frame 54. The fixing boss 54A is protruded rearward. At the rear surface of the grip casing 60 is formed a boss insertion part 74, which communicates with the fixing hole 54B of the front door frame 54 and the fixing hole 73 of the grip casing 60 such that the fixing boss 54A of the front door frame 54 is inserted into the boss insertion part 74.

As the grip casing 60 is attached to the rear surface of the front door frame 54 such that the fixing boss 54A is inserted into the boss insertion part 74, the grip casing 60 is properly located by means of the boss insertion part 74 and the fixing boss 54A, and therefore, the grip casing 60 is more stably attached to the rear surface of the front door frame 54.

The hook assembly 80 comprises: a hook 82 disposed through the insertion hole 60A of the grip casing 60 and the through-hole 52A of the rear door frame 52, the hook 82 having one end inserted in a locking fashion into the hook hole of the cabinet cover; a hook shaft 84, to which the other end of the hook 82 is hingedly attached, the hook shaft 84 having both ends respectively supported by supporting parts 76 formed at the inside part of the rear surface of the grip casing 60; a handle 86, having one end hingedly attached to the hook shaft 84 and the other end disposed at the grip hole 58, for moving the hook 82 in a hinged fashion; and resilient members 88, each having both ends disposed at the hook 82 and the front door frame 54, respectively, for resiliently supporting the hook 82.

The insertion hole 60A of the grip casing 60 and the through-hole 52A of the rear door frame 52 have sufficient sizes in the lateral direction of the drum type washing machine, respectively, such that the hook 82 can be moved in a hinged fashion in the lateral direction of the drum type washing machine by the handle 86. The supporting parts 76 are formed above and below the insertion hole 60A of the grip casing 60.

Specifically the supporting parts 76 comprise: a first supporting part 76A disposed above the insertion hole 60A for supporting one end of the hook shaft 84; and a second supporting part 76B disposed below the insertion hole 60A for supporting the other end of the hook shaft 84.

The handle 86 is provided at one side thereof with a fitting hole 86A, through which one end of the hook 82 is fitted. The handle 86 is provided at the other side thereof with a grip part 86B, which is disposed inside the grip hole 58 such that the grip part 86B is manipulated by the user of the drum type washing machine. As the grip part 86B is manipulated by the user of the drum type washing machine, the handle 86 is moved in a hinged fashion about the hook shaft 84, and therefore, the hook 82 is moved in the lateral direction of the drum type washing machine while being inserted in a locking fashion through the fitting hole 86A.

The resilient members 88 are coil springs wound on the hook shaft 84. The inner ends of the resilient members 88 are held at the left and right side surfaces of the hook 84, respectively, and the outer ends of the resilient members 88 are held at the rear surface of the front door frame part 54.

After the resilient members 88 are disposed on the hook shaft 84, the inner ends of the resilient members 88 are held at the hook 82, and the outer ends of the resilient members 88 are pressed by the front door frame part 54 as the grip casing 60 is attached to the rear surface of the front door frame 54, and therefore, resilient forces are provided to the hook 82.

The assembling process and the operation of the door of the drum type washing machine with the above-stated construction according to the first preferred embodiment of the present invention will now be described.

After the hook 82, the resilient members 88, and the handle 86 are temporarily connected to the hook shaft 84 of the hook assembly 80, both ends of the hook shaft 84 are fixed to the first and second supporting parts 76A and 76B of the grip casing 60.

At this time, one end of the hook 82 is disposed through the insertion hole 60A of the grip casing 60, and the grip part 86B of the handle 86 is disposed at the opening 62 of the grip casing 60.

After the hook assembly 80 is disposed at the inside part of the rear surface of the grip casing 60 as described above, the grip casing 60 is attached to the rear surface of the front door frame 54 such that the opening 62 of the grip casing 60 communicates with the grip hole 58 of the front door frame 54.

At this time, the grip casing 60 is located between the locking parts 64 formed at the rear surface of the front door frame 54 such that the locking parts 64 come into tight contact with the side surfaces of the grip casing 60, and the locking protrusions 66 formed at the sides of the grip casing 60 are guided into the locking holes 64A of the locking parts 64 by the guide ribs, and therefore, the locking protrusions 66 are inserted in a locking fashion into the locking holes 64A, respectively.

After the grip casing 60 is attached to the front door frame 54 as described above, the edge of the door glass 56 is located at the inner circumferential surface of the rear door frame 52. After one end of the door hinge is temporarily connected to one lateral side of the rear door frame 52, the front door frame 54 is attached to the front surface of the rear door frame 52.

As a result, the edge of the door glass 56 is securely fixed by the front door frame 54 and the rear door frame 52, and the edge of the door glass 56 and the rear door frame 52 come into tight contact with the rear surface of the grip casing 60.

The door glass 56 is properly located by the locating rib 70 of the grip casing 60, and the edge of the door glass 56 is securely fixed to the rear door frame 52 by the fixing rib 72 of the grip casing 60.

The front door frame 54 is securely fixed to the rear door frame 52 by engaging the fixing member into the fixing holes 54B and 52B. Another fixing member is inserted through the fixing hole 73 of the grip casing 60 to securely fix the grip casing 60.

After the front door frame 54 is securely fixed to the rear door frame 52 by the fixing member, the other end of the door hinge is connected to the front surface of the cabinet cover. In this way, the door 50 is attached to the drum type washing machine.

The door 50 with the above-stated construction is operated as follows: when a user pushes the handle 86 of the hook assembly 80, disposed in the grip hole 58, forward, the hook 82 is moved in a hinged fashion by the handle 86, and therefore, the locked state of the door 50 is released. The door 50 is moved in a hinged fashion in the lateral direction of the drum type washing machine by the user holding the grip hole 58, and therefore, the laundry inlet/outlet hole of the cabinet cover is opened or closed.

When the pushed state of the handle 86 is released after the door 50 comes into tight contact with the cabinet cover such that the laundry inlet/outlet hole is closed, the hook 82 is returned to its original state by the resilient members 88 while being inserted in the hook hole of the cabinet cover. As a result, the hook 82 is caught in the hook hole of the cabinet cover, and therefore, the door 50 is locked.

When the door 50 is opened or closed, or the user of the drum type washing machine views the door 50 from other angles, the interiors of the front door frame 54 and the rear door frame 52 are exposed to the outside through the grip hole 58.

However, the grip casing 60 is mounted inside the grip hole 58, and the surface of the grip casing 60 is plated with the same material as the plating material for the front door frame 54. As a result, the rear surface of the rear door frame 52 and the structural components inside the front door frame 54 and the rear door frame 52 are hidden by the grip casing 60, and the inside of the grip hole 58 is neatly formed.

Figure 12:
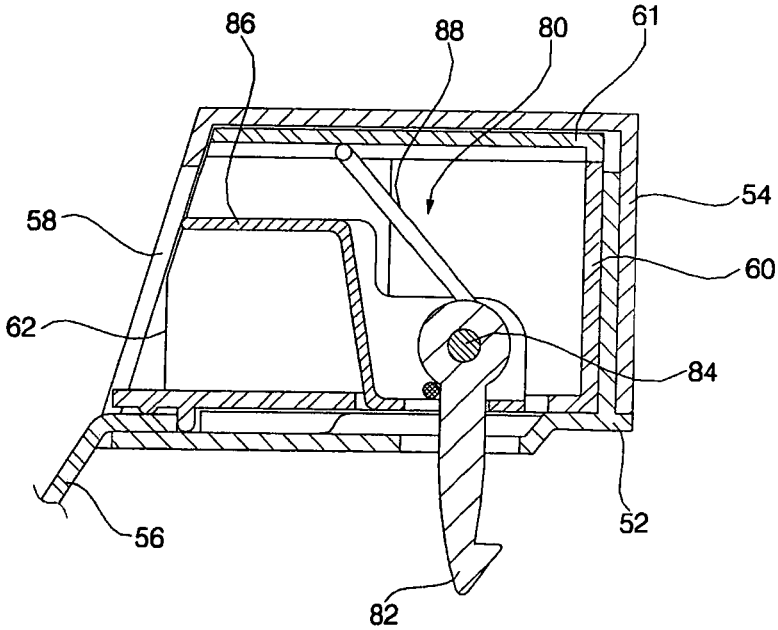
FIG. 12 is a sectional view illustrating a hook assembly disposed in a door of a drum type washing machine according to a second preferred embodiment of the present invention.

FIG. 12 is a sectional view illustrating a hook assembly disposed in a door of a drum type washing machine according to a second preferred embodiment of the present invention.

Components of the door according to the second preferred embodiment, which are identical or similar to those of the door according to the first preferred embodiment, are indicated by the same reference numerals as those of the door according to the first preferred embodiment, and a detailed description thereof will not be given.

In the door of the drum type washing machine according to the second preferred embodiment of the present invention shown in FIG. 14, a casing cover 61 is additionally disposed at the open front part of the grip casing 60. The casing cover 61 is attached to the rear surface of the front door frame 54 while being in tight contact with the rear surface of the front door frame 54. Other construction of the second preferred embodiment is identical to that of the first preferred embodiment.

The grip casing 60 is formed in the shape of a box having an open front part. The hook assembly 80 is mounted in the grip casing 60, and then the casing cover 61 is disposed at the front part of the grip casing 60. As a result, the inner ends of the resilient members 88 of the hook assembly 80 are held at the hook 82, and the outer ends of the resilient members 88 of the hook assembly 80 are pressed by the casing cover 61. Consequently, resilient forces are provided to the hook 82.

In the case that the casing cover 61 is additionally disposed at the open front part of the grip casing 60 as described above, the grip casing 60, the hook assembly 80, and the casing cover 61 can be provided as a single module, which is easily and conveniently attached to the rear surface of the front door frame 54. Consequently, components of the door can be easily charged and handled.

As apparent from the above description, the grip casing is mounted to the rear surface of the front door frame such that the grip casing communicates with the grip hole, and the hook assembly is disposed inside the grip casing. Consequently, the present invention has the effect of preventing the interiors of the front door frame and the rear door frame from being exposed to the outside through the grip hole by the grip casing and allowing the hook assembly to be easily and conveniently mounted to the door frame.

Furthermore, the hook assembly is disposed inside the grip casing. As a result, the hook assembly is not protruded outside the grip hole, and the door frame is formed in the shape of a complete ring. Consequently, the present invention has the effect of improving the pleasing appearance of the door and increasing marketability of drum type washing machines having such doors.

In addition, the hook assembly is disposed inside the grip casing, and then the grip casing is attached to the front surface of the front door frame. Consequently, the present invention has the effect of easily and conveniently performing the assembling process of the hook assembly and preventing the hook assembly from being incorrectly assembled.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door of a drum washing machine, comprising:

a front surface;

a rear surface spaced from the front surface;

an inner circumferential surface and an outer circumferential surface extending between the front and rear surfaces;

an opening in the inner circumferential surface;

a casing provided between the front surface and the rear surface and communicating with the opening;

a hook assembly in the casing and extending through the rear surface; and a handle attached to the hook assembly and extending toward the opening, the handle located between the front surface and the rear surface.

2. The door of claim 1, further comprising:

a glass extending radially inwardly from the inner circumferential surface.

3. The door of claim 2, wherein the glass is retained between the rear surface and a bottom surface of the casing.

4. The door of claim 1, wherein the handle does not extend past the inner circumferential surface.

5. The door of claim 1, wherein the hook assembly comprises:

a hook extending through the rear surface;

a hook shaft, the hook rotatably connected to the hook shaft.

6. The door of claim 5, further comprising resilient members biasing the hook to a first position.

7. The door of claim 1, wherein the casing includes a bottom wall extending along the rear surface and a side wall extending along the outer circumferential surface.

8. The door of claim 1, further comprising:

a rear door frame having the rear surface and at least one wall extending from the rear surface;

a front door frame having the front surface and at least one wall extending from the front surface;

the casing being a piece separate from the rear door frame and front door frame.

9. The door of claim 8, further comprising:

locking parts attached to the front frame, the locking parts having a locking hole;

a locking protrusion attached to the casing, the locking protrusion engaging the locking hole to connect the casing to the front frame.

* * * * *